US010202887B2

(12) United States Patent
Sato

(10) Patent No.: US 10,202,887 B2
(45) Date of Patent: Feb. 12, 2019

(54) COOLING WATER PASSAGE STRUCTURE FOR INTERNAL COMBUSTION ENGINE

(71) Applicant: HONDA MOTOR CO., LTD., Tokyo (JP)

(72) Inventor: Taichi Sato, Wako (JP)

(73) Assignee: Honda Motor Co., Ltd., Tokyo (JP)

( * ) Notice: Subject to any disclaimer, the term of this patent is extended or adjusted under 35 U.S.C. 154(b) by 0 days.

(21) Appl. No.: 15/896,684

(22) Filed: Feb. 14, 2018

(65) Prior Publication Data

US 2018/0230893 A1 Aug. 16, 2018

(30) Foreign Application Priority Data

Feb. 15, 2017 (JP) ..... 2017-026169

(51) Int. Cl.
*F01P 7/16* (2006.01)
*F01P 3/02* (2006.01)
(Continued)

(52) U.S. Cl.
CPC ..... *F01P 7/161* (2013.01); *F01P 3/02* (2013.01); *F01P 3/12* (2013.01); *F01P 2007/146* (2013.01)

(58) Field of Classification Search
CPC ..... F01P 7/161; F01P 7/16; F01P 3/02; F01P 3/12; F01P 2007/146; F01P 2060/12
See application file for complete search history.

(56) References Cited

U.S. PATENT DOCUMENTS 6,182,616 B1 * 2/2001 Itoh ..... F01M 5/002 123/41.1
6,732,679 B2 * 5/2004 Iizuka ..... F01P 7/16 123/41.1
(Continued)

FOREIGN PATENT DOCUMENTS

JP S58120879 U 8/1983
JP S62119438 U 7/1987
(Continued)

OTHER PUBLICATIONS

Decision to Grant a Patent issued in Japanese Patent Application No. 2017-026169 dated Aug. 14, 2018, and machine translation, 6 pages.
(Continued)

*Primary Examiner* — Grant Moubry
(74) *Attorney, Agent, or Firm* — Armstrong Teasdale LLP

(57) ABSTRACT

A cooling water passage structure (10) for an internal combustion engine (1) provided with a supercharger (8), comprises a passage forming member (14) attached to a main body (2) of the internal combustion engine, and internally defining a branch passage (13) communicating with an outlet (12B) of a main body water jacket (12) formed in the main body of the internal combustion engine, and a water temperature sensor (80) provided in the passage forming member to detect a temperature of the cooling water flowing through the branch passage. The water temperature sensor is positioned in a part of a main supply passage (31) defined in the passage forming member closer to an inlet end of the main supply passage than a junction between the main supply passage and a supercharger return passage (34) is.

9 Claims, 7 Drawing Sheets

(51) Int. Cl.
*F01P 3/12* (2006.01)
*F01P 7/14* (2006.01)

(56) References Cited

U.S. PATENT DOCUMENTS

| | | | | |
|---|---|---|---|---|
| 6,758,173 | B2 * | 7/2004 | Saito | F01P 3/02 123/41.57 |
| 8,220,421 | B2 * | 7/2012 | Utsuno | F01N 5/02 123/41.08 |
| 8,752,531 | B2 * | 6/2014 | Bell | F02B 29/0437 123/559.1 |
| 8,844,474 | B2 * | 9/2014 | Fukuoka | F01P 3/02 123/41.08 |
| 9,086,009 | B2 * | 7/2015 | Mikame | F01P 3/202 |
| 9,341,106 | B2 * | 5/2016 | Hayase | F01P 7/165 |
| 2013/0125843 | A1 | 5/2013 | Fukuoka et al. | |

FOREIGN PATENT DOCUMENTS

| | | | |
|---|---|---|---|
| JP | S62199920 | A | 9/1987 |
| JP | H04259622 | A | 9/1992 |
| JP | H0571357 | A | 3/1993 |
| JP | 2006266196 | A | 10/2006 |
| JP | 2009150228 | A | 7/2009 |
| JP | 2010209882 | A | 9/2010 |
| JP | 2013108429 | A | 6/2013 |
| JP | 2013113118 | A | 6/2013 |
| JP | 2013217344 | A | 10/2013 |
| JP | 2013238121 | A | 11/2013 |
| JP | 2017031909 | A | 2/2017 |

OTHER PUBLICATIONS

Search Report issued in Japanese Patent Application No. 2017-026169 dated Aug. 6, 2018, and machine translation, 18 pages.

* cited by examiner

COOLING WATER PASSAGE STRUCTURE FOR INTERNAL COMBUSTION ENGINE

TECHNICAL FIELD

The present invention relates to a cooling water passage structure for an internal combustion engine.

BACKGROUND ART

A known water cooled internal combustion engine includes a single passage forming member (water outlet) internally defining a branch passage for distributing the cooling water that has passed through a water jacket formed in an engine main body to passages leading to a radiator, a heater core and an ATF warmer, and fitted with a thermostat for switching the supply of the cooling water to the radiator depending on the temperature of the cooling water, and a water temperature sensor for detecting the temperature of the cooling water that has passed through the engine main body. See JP2013-108429A, for instance. The use of the passage forming member contributes to the simplification and the size-reduction of the piping structure for the cooling water passages.

When the engine is equipped with a supercharger (typically consisting of a turbocharger) provided with a water jacket, the cooling water that has passed through the supercharger may be returned to the passage forming member with the aim of simplifying the piping structure. However, the cooling water that has just passed through the supercharger may have a substantially higher temperature than the cooling water that has passed through the engine main body. Therefore, if the cooling water that has passed through the supercharger is returned to a part adjacent to the water temperature sensor intended for measuring the temperature of the cooling water that has just passed through the engine main body, the water temperature sensor is unable to detect the correct temperature of the cooling water. Also, the cooling water that has passed through the supercharger may cause an undesired temperature rise in the heater core or the ATF warmer.

SUMMARY OF THE INVENTION

In view of such a problem of the prior art, a primary object of the present invention is to provide a cooling water passage structure for an internal combustion engine in which the cooling water that has just passed through the supercharger is prevented from causing an incorrect detection of the cooling water temperature, and from adversely affecting other auxiliary devices.

To achieve such an object of the present invention, the present invention provides a cooling water passage structure (10) for an internal combustion engine (1) provided with a supercharger (8), comprising: a passage forming member (14) attached to a main body (2) of the internal combustion engine, and internally defining a branch passage (13) communicating with an outlet (12B) of a main body water jacket (12) formed in the main body of the internal combustion engine; and a water temperature sensor (80) provided in the passage forming member to detect a temperature of the cooling water flowing through the branch passage; wherein the branch passage comprises a main supply passage (31) including an inlet end (31A) communicating with the outlet of the main body water jacket and an outlet end (31B) communicating with an inlet of a radiator (15), and a supercharger return passage (34) communicating with an outlet of a supercharger water jacket (66) formed in the supercharger, the water temperature sensor being positioned in a part of the main supply passage closer to the inlet end of the main supply passage than a junction between the main supply passage and the supercharger return passage is.

Because the cooling water that has passed through the supercharger flows into a part of the main supply passage more downstream than the water temperature sensor, the part of the cooling water heated by the supercharger is prevented from reaching the water temperature sensor. Therefore, the water temperature sensor is prevented from being affected by the cooling water that has just passed through the supercharger, and can accurately measure the temperature of the cooling water that has just passed through the main body water jacket.

Preferably, the branch passage further comprises a heater core supply passage (35) that branches off from a part of the main supply passage closer to the inlet end than the junction between the main supply passage and the supercharger return passage is, and is connected to an inlet of a heater core (22).

Thereby, the cooling water that has passed through the supercharger flows into a part of the main supply passage more downstream than the junction with the heater core supply passage so that the cooling water heated by the supercharger is prevented from reaching the heater core supply passage. Therefore, the cooling water that has passed through the supercharger is mainly forwarded to the radiator so that the excessive heating of the heater core can be avoided.

Preferably, the main supply passage is bent in an intermediate part thereof between the inlet end and the outlet end, and is provided with an extension (31E) extending from the inlet end away from the outlet end, the heater core supply passage branching off from the extension.

Thereby, the cooling water that has passed through the supercharger is prevented from reaching the heater core in an even more favorable manner.

Preferably, the branch passage further comprises a working fluid warmer supply passage (37) that branches off from a part of the main supply passage closer to the inlet end than the junction between the main supply passage and the supercharger return passage, and is connected to an inlet of a working fluid warmer (21) for exchanging heat between a working fluid of a transmission system and cooling water.

Because the cooling water that has passed through the supercharger flows into a part of the main supply passage more downstream than the junction with the working fluid warmer supply passage, the cooling water heated by the supercharger is prevented from reaching the working fluid warmer supply passage. Therefore, the cooling water that has passed through the supercharger is forwarded to the radiator to be efficiently cooled, and the working fluid warmer is prevented from being heated in an excessive manner.

Preferably, the branch passage further comprises a throttle supply passage (39) that branches off from a part of the main supply passage closer to the inlet end than the junction between the main supply passage and the supercharger return passage is, and is connected to an inlet of a throttle water jacket (23A) formed in a throttle body (23B).

Because the cooling water that has passed through the supercharger flows into a part of the main supply passage more downstream than the junction with the throttle supply passage, the cooling water heated by the supercharger is prevented from reaching the throttle supply passage. Therefore, the cooling water that has passed through the supercharger is forwarded to the radiator to be efficiently cooled, and the throttle body is prevented from being heated in an excessive manner.

Preferably, the throttle supply passage branches off from a part of the main supply passage more remote from the supercharger return passage than the heater core supply passage and the working fluid warmer supply passage are.

Thereby, the cooling water heated by the supercharger is prevented from reaching the throttle water jacket in a most effective manner.

Preferably, the branch passage further comprises: a main return passage (32) having a first end (32A) connected to an outlet of the radiator and a second end (32B) connected to an inlet (16A) of a water pump (16) for pumping cooling water to an inlet of the main body water jacket; a bypass passage (33) connecting the main supply passage to the main return passage; and a flow control valve (54) provided in at least one of the main return passage and the bypass passage to regulate a flow of cooling water in the bypass passage, the bypass passage being connected to a part of the main supply passage between the water temperature sensor and the junction with the supercharger return passage.

Because the bypass passage is connected to a part of the main supply passage more downstream than the water temperature sensor, even when the cooling water passes through the bypass passage, instead of the radiator, the cooling water that has passed through the supercharger is conducted to the bypass passage, and prevented from reaching the water temperature sensor. As a result, the water temperature sensor is prevented from being affected by the cooling water that has passed through the supercharger, and can accurately measure the temperature of the cooling water that has passed through the main body water jacket.

Preferably, the outlet (66B) of the supercharger water jacket is positioned above an inlet (66A) of the supercharger water jacket, and a pipe (18E) connected to the outlet of the supercharger water jacket has a larger cross sectional area than a pipe (18D) connected to the inlet of the supercharger water jacket.

Thereby, even when the cooling water in the supercharger water jacket should boil, the steam can be expelled in a favorable manner because the outlet of the supercharger water jacket is located higher than the inlet thereof, and the outlet has a greater cross sectional area than the inlet. Therefore, steam and/or air are prevented from being trapped in the supercharger water jacket.

Preferably, the inlet and outlet of the supercharger water jacket open out at a common fastening surface (63A), and the pipes are connected to the inlet and outlet of the supercharger water jacket, respectively, via a common connecting member (67) configured to be fastened to the common fastening surface.

Thereby, the work required for connecting the pipes to the supercharger water jacket can be facilitated.

Thus, the present invention provides a cooling water passage structure for an internal combustion engine in which the cooling water that has just passed through a supercharger is prevented from causing an incorrect detection of the cooling water temperature, and from adversely affecting other auxiliary devices.

PREFERRED EMBODIMENT(S)

An automotive internal combustion engine incorporated with a cooling water passage structure embodying the present invention is described in the following with reference to the appended drawings.

Figure 1:
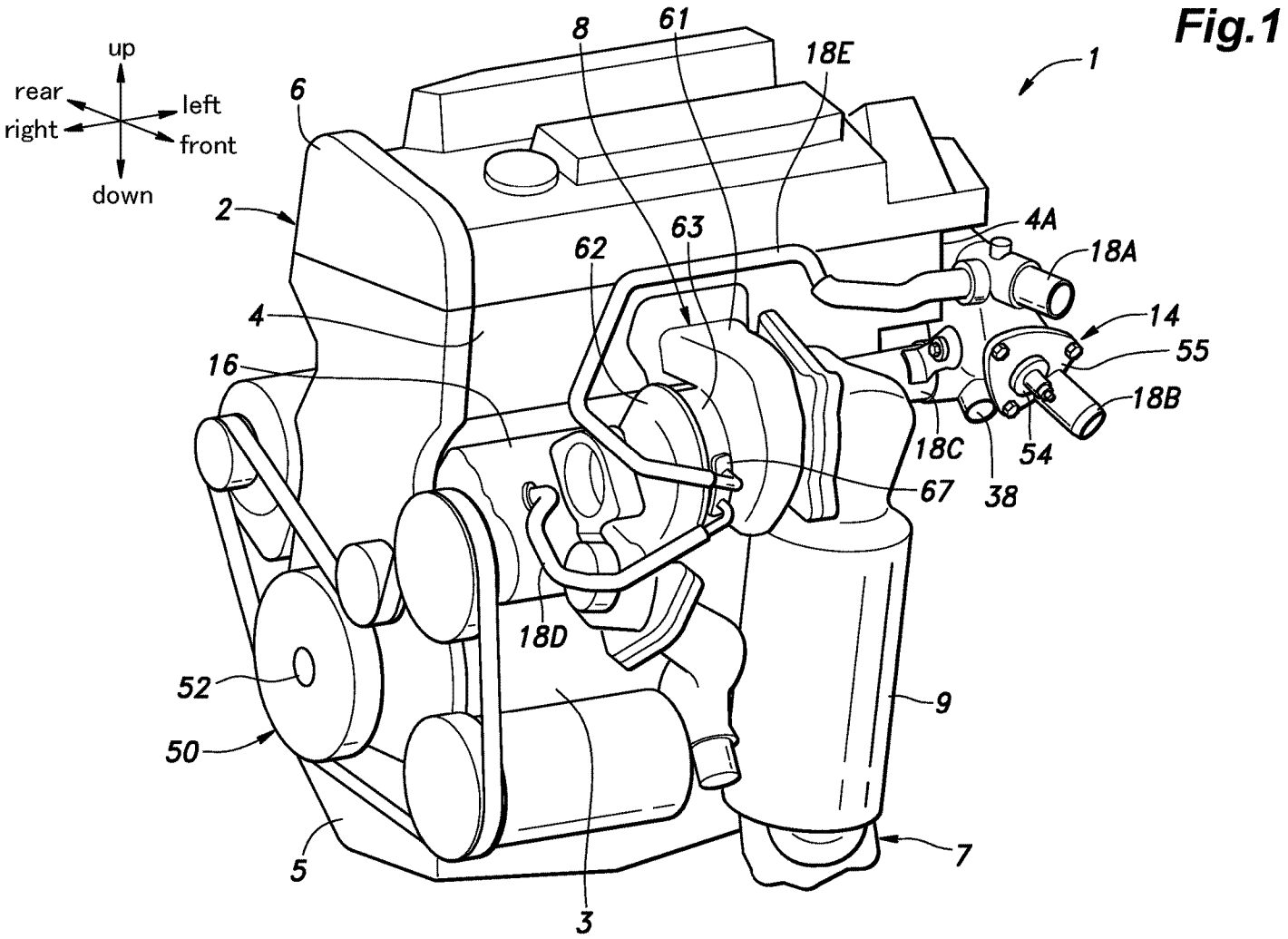
FIG. 1 is a perspective view of an internal combustion engine according to an embodiment of the present invention.
Figure 2:
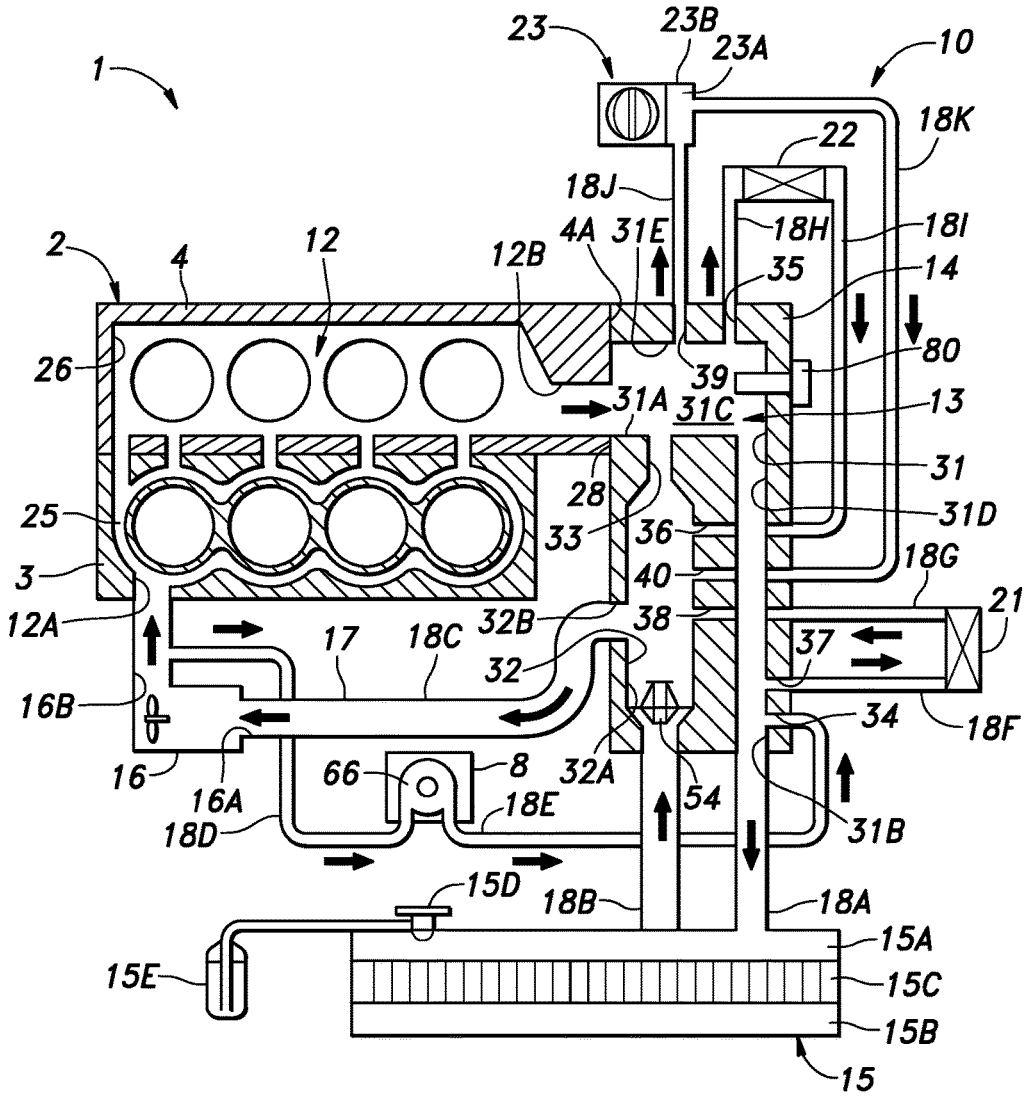
FIG. 2 is a diagram illustrating a cooling water passage structure of the internal combustion engine.

As shown in FIGS. 1 and 2, an engine main body 2 of an internal combustion engine 1 includes a cylinder block 3 formed with a plurality of cylinders, a cylinder head 4 attached to the upper end of the cylinder block 3 and defining combustion chambers in cooperation with the cylinder block 3, an oil pan 5 attached to the lower end of the cylinder block 3, and a head cover 6 attached to the upper end of the cylinder head 4. As shown in FIG. 1, in this internal combustion engine 1, the crankshaft axis is directed in the lateral direction of the vehicle, and the exhaust side of the engine 1 is on the front side. An upstream end of an exhaust pipe 7 is connected to the front side of the cylinder head 4. The exhaust pipe 7 is provided with a turbocharger 8 and a catalytic converter 9 in this order from the upstream side, and extends downward along the front side of the cylinder block 3. The exhaust pipe 7 is bent rearward, and extends rearward under the oil pan 5.

The internal combustion engine 1 is provided with a cooling water passage structure 10 for supplying cooling water to the engine main body 2 and a plurality of auxiliary devices as will be described later. The cooling water passage structure 10 includes a main body water jacket 12 formed in the engine main body 2, a branch passage 13 formed in a passage forming member 14 attached to the engine main body 2 and communicating with the main body water jacket 12, a radiator 15 for cooling the cooling water, a cooling water pump 16 for pumping the cooling water, and a piping system 18 for forming a circulating cooling water passage system 17 by connecting the main body water jacket 12, the branch passage 13, various auxiliary devices, the radiator 15 and the water pump 16 in a prescribed order. The piping system 18 may be formed with metal pipe, plastic pipe, plastic hose or the like. The auxiliary devices include an ATF warmer 21, a heater core 22, and an electric throttle valve 23 in addition to the turbocharger 8.

The main body water jacket 12 includes a block water jacket 25 formed in the cylinder block 3 and a head water jacket 26 formed in the cylinder head 4. The block water jacket 25 and the head water jacket 26 are communicated with each other. A main body water jacket inlet 12A opens out at the front side of the cylinder block 3, and communicates with the block water jacket 25. A main body water jacket outlet 12B opens out at the outer side of a left end wall 4A of the cylinder head 4, and communicates with the head water jacket 26.

The passage forming member 14 is attached, at a joining surface 28 thereof, to the outer side of the left end wall 4A of the cylinder head 4. The passage forming member 14 extends forward and downward from the left end wall 4A of the cylinder head 4. As shown in FIGS. 2 to 6, the branch passage 13 defined in the passage forming member 14 includes a main supply passage 31, a main return passage 32, a bypass passage 33, a turbocharger return passage 34, a heater core supply passage 35, a heater core return passage 36, an ATF warmer supply passage 37, an ATF warmer return passage 38, a throttle supply passage 39, and a throttle return passage 40.

The main supply passage 31 is provided with an inlet end 31A opening out at the joining surface 28 and connected to the main body water jacket outlet 12B, and an outlet end 31B opening out at the front upper part of the passage forming member 14. The main supply passage 31 includes a chamber portion 31C provided in a part opposing the inlet end 31A, a passage portion 31D extending forward and upward from the chamber portion 31C to the outlet end 31B, and an extension 31E extending from the chamber portion 31C in a direction heading away from the passage portion 31D (rearward). The chamber portion 31C and the passage portion 31D of the main supply passage 31 form a bent passage extending from the inlet end 31A to the outlet end 31B. The chamber portion 31C has a larger cross sectional area than the passage portion 31D and the extension 31E. The outlet end 31B of the main supply passage 31 is connected to the inlet of the radiator 15 via a pipe 18A.

As shown in FIG. 2, the radiator 15 is provided with an upper tank 15A, a lower tank 15B, and a radiator core 15C that is connected between the upper tank 15A and the lower tank 15B. An inlet of the radiator 15 is provided in the upper tank 15A, and an outlet of the radiator 15 is provided in the lower tank 15B. The upper tank 15A is connected to a reserve tank 15E via a pressure regulating cap 15D.

As shown in FIGS. 2, 3, 5, and 6, the main return passage 32 includes an inlet end 32A that opens at the front side of a front lower portion of the passage forming member 14 and an outlet end 32B that opens at the right side of the front lower portion of the passage forming member 14. The main return passage 32 is disposed in front of and below the main supply passage 31 in the passage forming member 14. The inlet end 32A of the main return passage 32 is connected to the outlet of the radiator 15 via a pipe 18B. The outlet end 32B of the main return passage 32 is connected to an inlet 16A of the water pump 16 via a pipe 18C.

As shown in FIG. 1, the water pump 16 is connected to the crankshaft 52 via a transmission mechanism 50 including a belt and pulleys, and is driven by the rotational force of the crankshaft 52. As shown in FIG. 2, a discharge port 16B of the water pump 16 is connected to the main body water jacket inlet 12A directly or via a pipe.

As shown in FIGS. 2 to 5, a bypass passage 33 extends forward and downward from the chamber portion 31C of the main supply passage 31, and opens into the main return passage 32. The cross sectional area of the bypass passage 33 is smaller than that of the main supply passage 31.

As shown in FIG. 2, the inlet end 32A of the main return passage 32 is provided with a flow control valve 54 for controlling the flow rate of the cooling water flowing through the radiator 15. In the illustrated embodiment, the flow control valve 54 consists of a per se known thermostat that opens and closes according to the temperature of the cooling water. When the temperature of the cooling water is lower than a predetermined temperature, the flow control valve 54 closes the inlet end 32A of the main return passage 32 to prohibit the flow of the cooling water into the radiator 15. On the other hand, when the temperature of the cooling water is higher than the predetermined temperature, the flow control valve 54 opens the inlet end 32A of the main return passage 32 to permit the circulation of the cooling water in the radiator 15. When the flow control valve 54 closes the inlet end 32A of the main return passage 32, the cooling water flows from the main supply passage 31 to the main return passage 32 via the bypass passage 33. On the other hand, when the flow control valve 54 opens the inlet end 32A of the main return passage 32, the cooling water flows through of the radiator 15 demonstrating a substantially lower flow resistance than the bypass passage 33 while the amount of the cooling water flowing through the bypass passage 33 is comparatively extremely small. As shown in FIG. 1, the pipe 18B connected to the inlet end 32A of the main return passage 32 and the flow control valve 54 are supported by a lid body 55 which closes the inlet end 31A.

Figure 7:
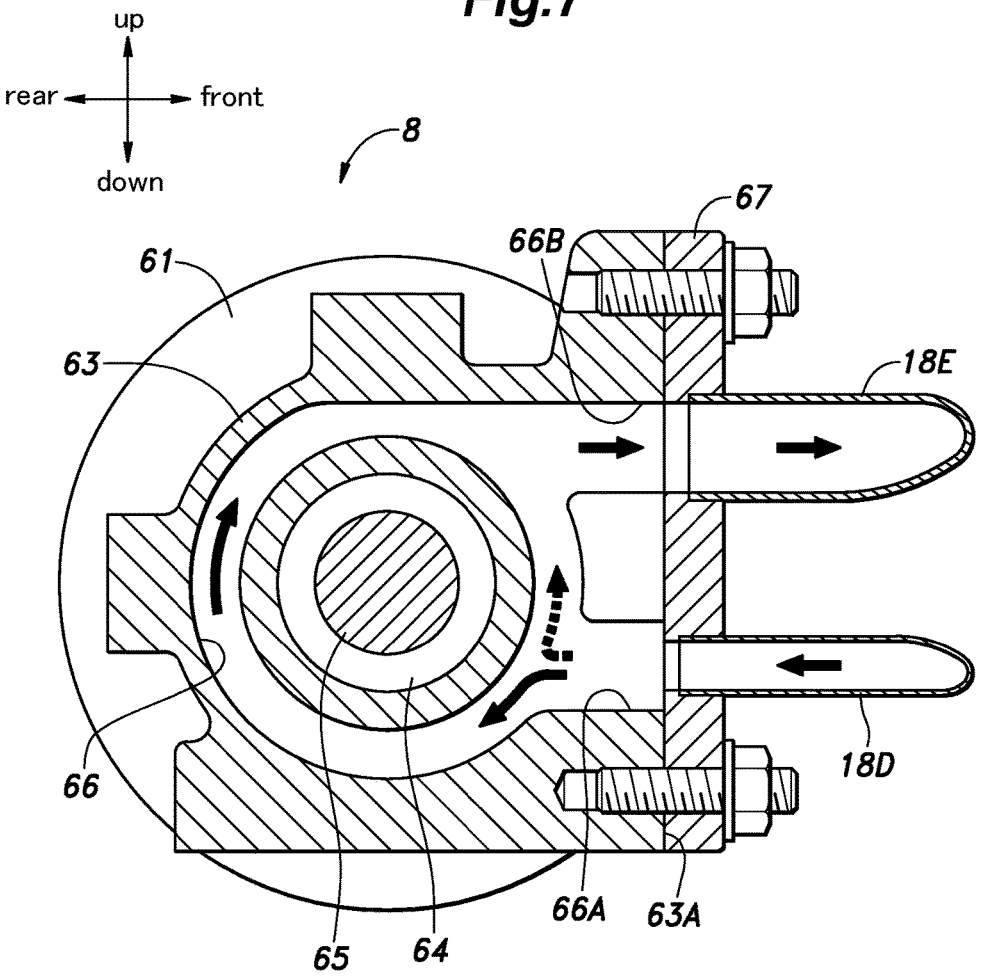
FIG. 7 is a sectional view showing a turbocharger water jacket.

The turbocharger 8 includes a turbine housing 61 provided on the exhaust pipe 7, a compressor housing 62 provided on the intake passage, and a bearing housing 63 having a tubular shape and provided between the turbine housing 61 and the compressor housing 62. A shaft 65 received in the bearing housing 63 extends in the lateral direction. As shown in FIG. 7, the shaft 65 that supports a turbine blade and a compressor blade is rotatably supported by a radial bearing 64 received in the bearing housing 63. A turbocharger water jacket 66 consisting of a passage for cooling water is formed in the bearing housing 63.

The turbocharger water jacket 66 is formed in a cylindrical shape concentric to the bearing housing 63, and has an axial line extending substantially in the lateral direction. The front end of the bearing housing 63 defines a flat fastening surface 63A. As shown in FIG. 7, an inlet 66A and an outlet 66B of the turbocharger water jacket 66 extend tangentially forward from a lower part and an upper part of the turbocharger water jacket 66, respectively, and open out at the fastening surface 63A. Thus, the inlet 66A of the turbocharger water jacket 66 is connected to the front lower part of the turbocharger water jacket 66 and the outlet 66B of the turbocharger water jacket 66 is connected to the front upper part of the turbocharger water jacket 66. The cooling water flows from the inlet 66A to the front lower part of the turbocharger water jacket 66, branches off to opposite circumferential directions, flows to the front side and the rear side, joins at the front upper part of the turbocharger water jacket 66 before being discharged to the outside from the outlet 66B.

Figure 3:
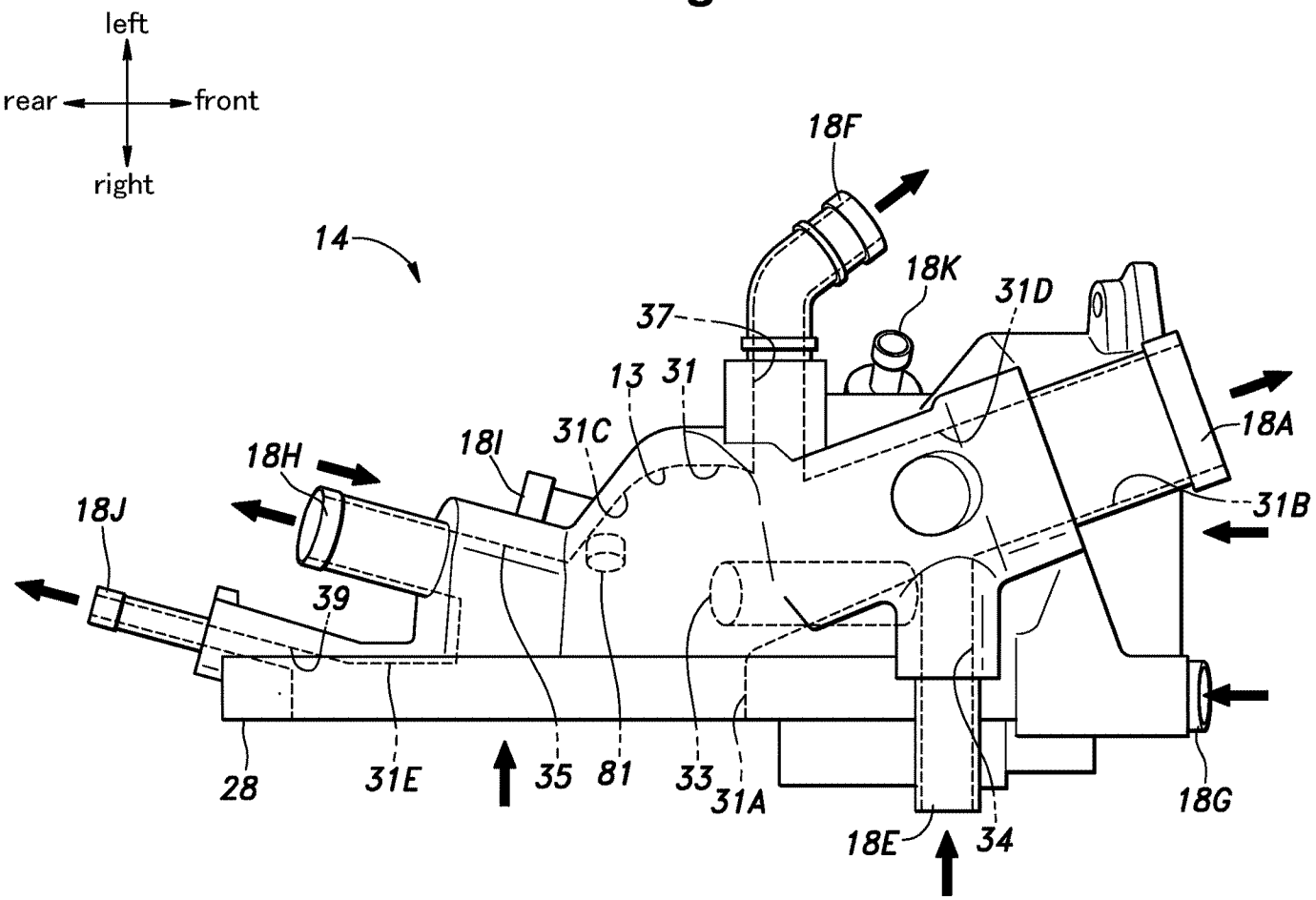
FIG. 3 is a plan view of a passage forming member (with a main supply passage and a passage connected to the main supply passage indicated by broken lines)

As shown in FIG. 2, the inlet 66A of the turbocharger water jacket 66 is connected to the discharge port 16B of the water pump 16 via a supply pipe 18D, and the outlet 66B of the turbocharger water jacket 66 is connected to the turbocharger return passage 34 of the passage forming member 14 via a discharge pipe 18E. As shown in FIG. 3, the turbocharger return passage 34 branches off from a part of the main supply passage 31 more on the side of the outlet end 31B than the junction with the bypass passage 33 is, and opens out at the right side of a front upper part of the passage forming member 14. The turbocharger return passage 34 is inclined with respect to the main supply passage 31 so as to face the side of the outlet end 31B at the junction with the main supply passage 31. In particular, the main supply passage 31 and the turbocharger return passage 34 merge together at an acute angle.

As shown in FIG. 7, the supply pipe 18D and the discharge pipe 18E share a common coupling member 67 at the ends thereof on the side of the turbocharger water jacket 66. The coupling member 67 consists of a plate member having a planar coupling surface, and the supply pipe 18D and the discharge pipe 18E are press fitted and fixed to the through holes formed in the coupling member 67. By fastening the coupling member 67 to the fastening surface 63A with threaded bolts, the supply pipe 18D and the discharge pipe 18E are connected to the inlet 66A of the turbocharger water jacket 66 and to the outlet 66B of the turbocharger water jacket 66, respectively, at the same time. The cross sectional area of the end portion of the discharge pipe 18E on the side of the turbocharger water jacket 66 is larger than the cross sectional area of the end portion of the supply pipe 18D on the side of the turbocharger water jacket 66. The discharge pipe 18E extends along the front side of the cylinder head 4 generally in the lateral direction. The end portion of the discharge pipe 18E on the side of the turbocharger return passage 34 is positioned above the end portion of the turbocharger water jacket 66 on the side of the outlet 66B.

Figure 4:
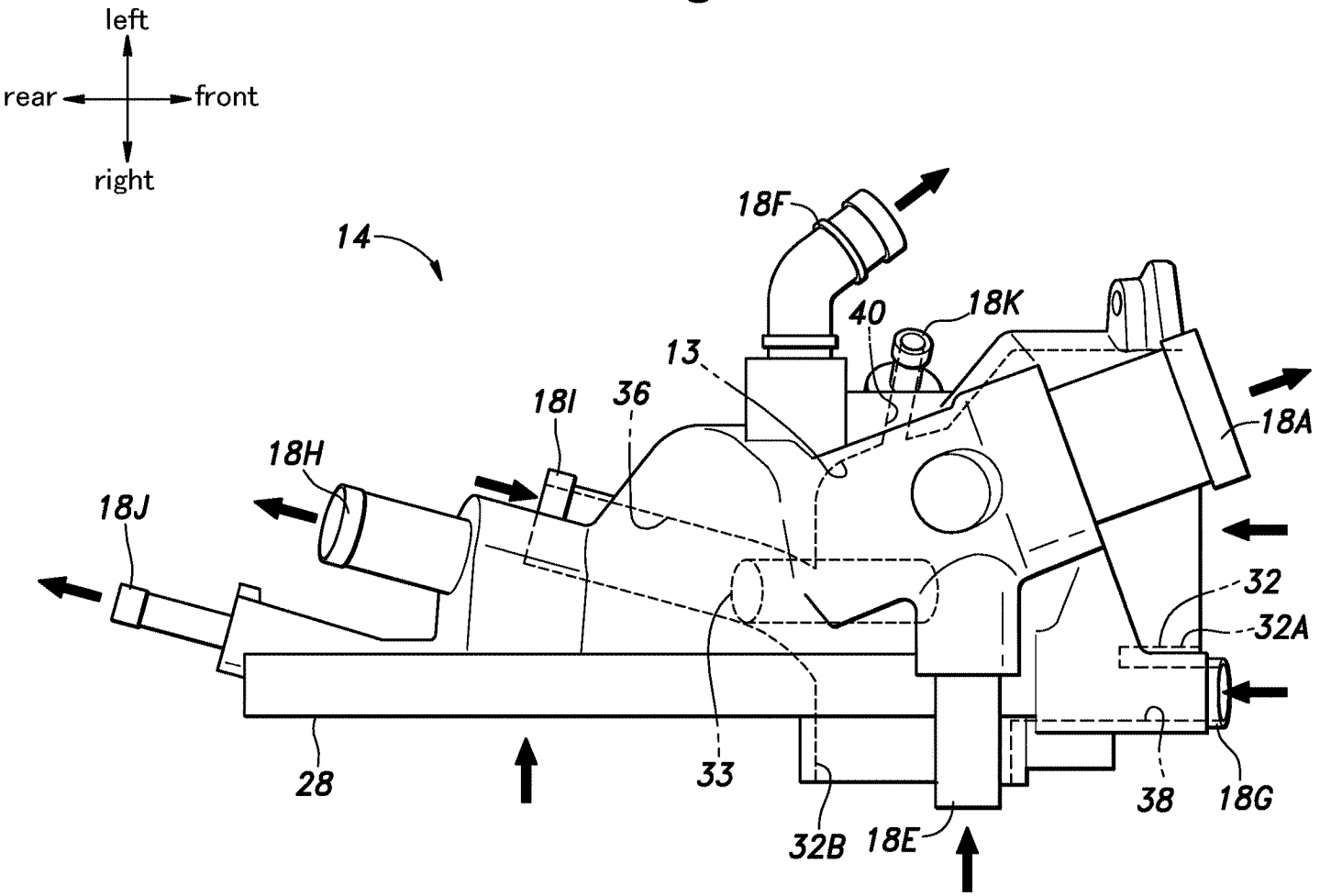
FIG. 4 is a plan view of the passage forming member (with a main return passage and a passage connected to the main return passage indicated by broken lines)
Figure 5:
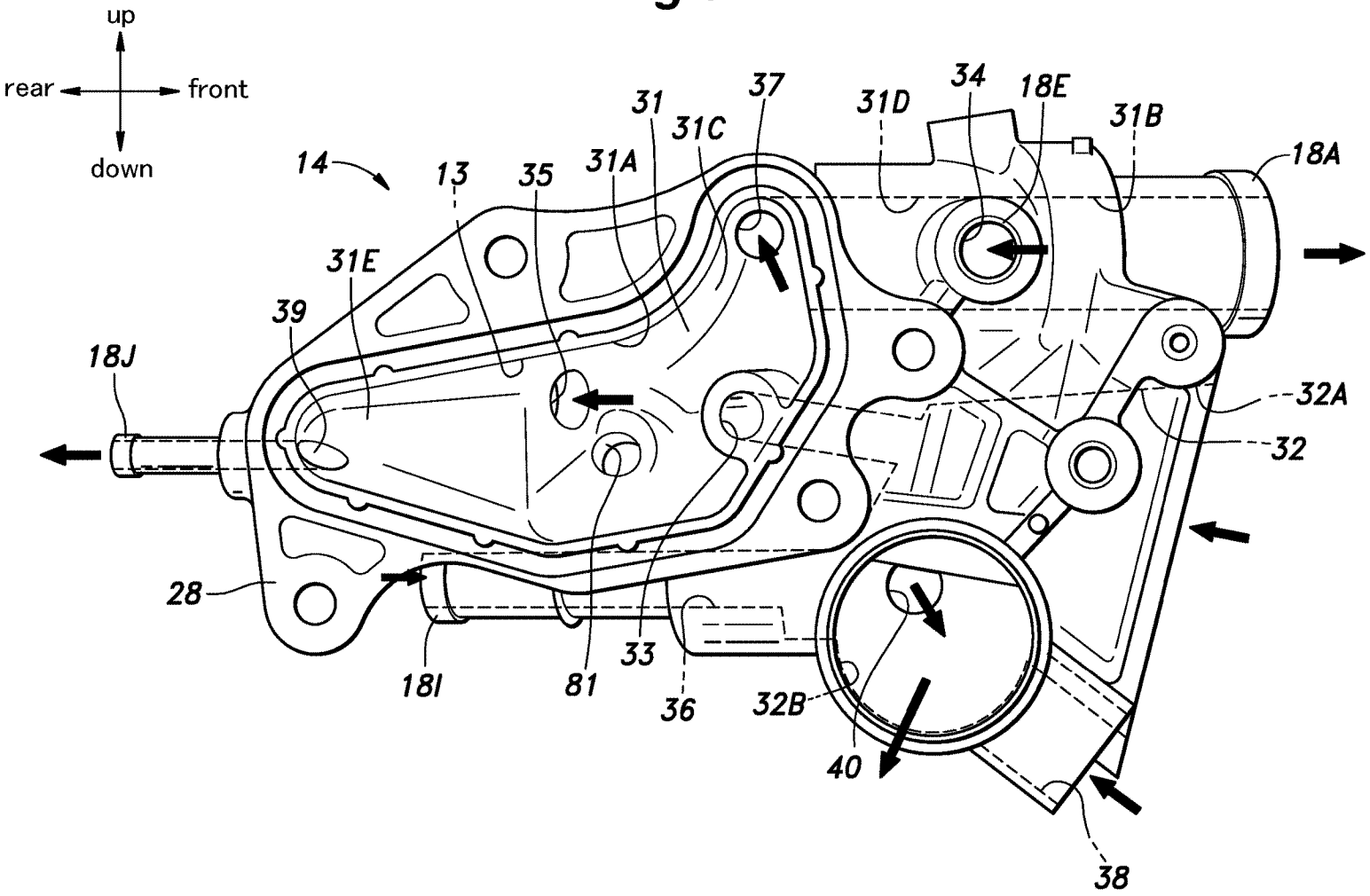
FIG. 5 is a right side view of the passage forming member.
Figure 6:
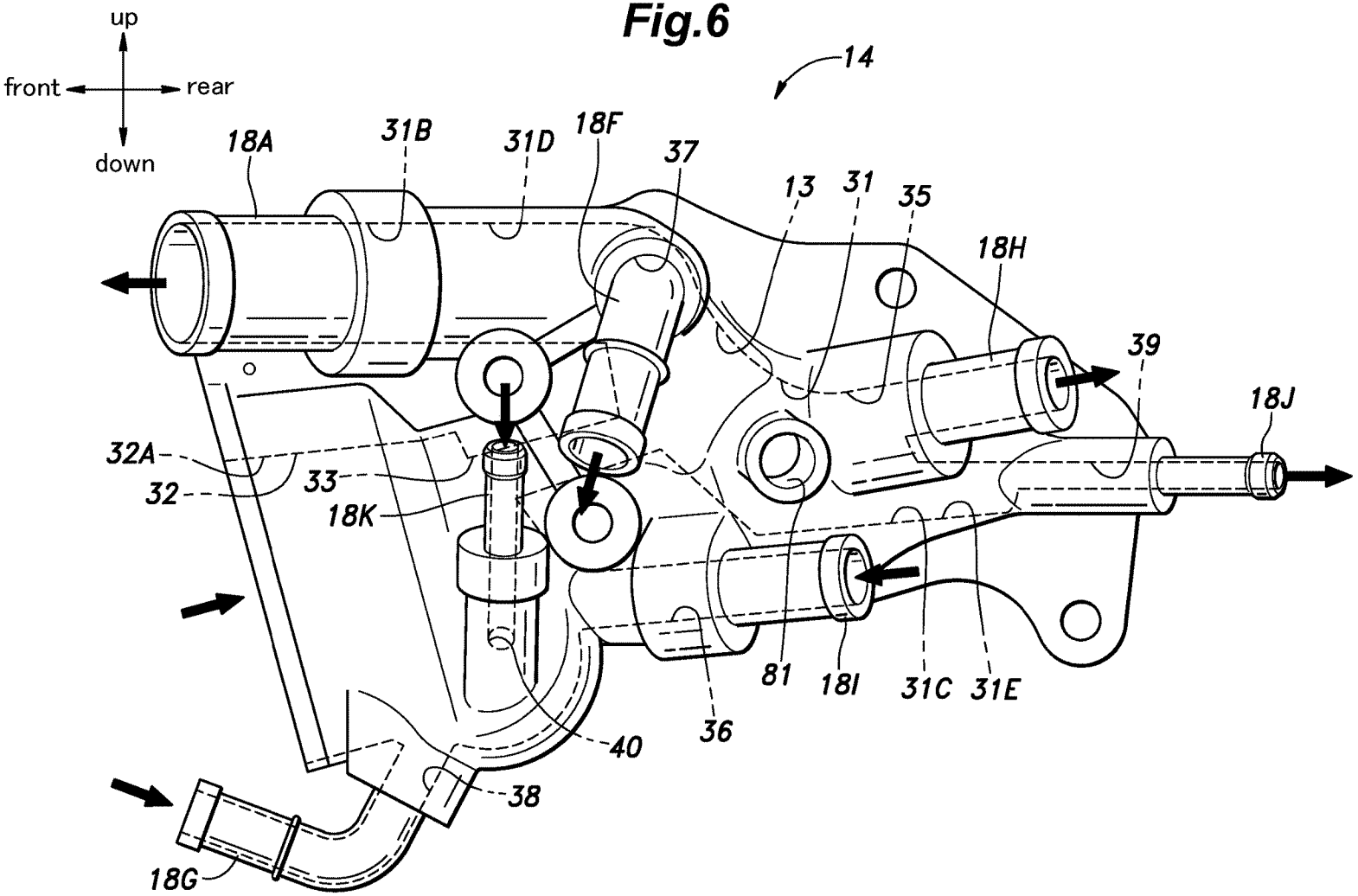
FIG. 6 is a left side view of the passage forming member.

As shown in FIG. 3, the ATF warmer supply passage 37 branches from a part of the main supply passage 31 closer to the inlet end 31A than the junction with the connecting portion of the turbocharger return passage 34 is. The ATF warmer supply passage 37 is connected to the passage portion 31D of the main supply passage 31. The ATF warmer supply passage 37 is inclined with respect to the main supply passage 31 so as to face the inlet end 31A at the junction with the main supply passage 31. In other words, the main supply passage 31 and the ATF warmer supply passage 37 diverge from each other at an acute angle. As shown in FIGS. 4 to 6, the ATF warmer return passage 38 extends forward and rightward from the main return passage 32, and opens out at the lower right part of the front side of the passage forming member 14. The ATF warmer return passage 38 is positioned under the inlet end 32A of the main return passage 32. The ATF warmer supply passage 37 is connected to the cooling water inlet of the ATF warmer 21 via a pipe 18F, and the ATF warmer return passage 38 is connected to the cooling water outlet of the ATF warmer 21 via a pipe 18G. The ATF warmer 21 exchanges heat between the ATF (automatic transmission fluid) flowing therein and the cooling water that passes through the main body water jacket 12 so that the ATF is maintained at a prescribed temperature level.

As shown in FIG. 3, the heater core supply passage 35 branches off from a part of the main supply passage 31 closer to the inlet end 31A than the junction with the turbocharger return passage 34 is, and opens out at an upper part of the left side of the passage forming member 14. The heater core supply passage 35 is connected to the extension 31E of the main supply passage 31. More specifically, the heater core supply passage 35 is connected to a part of the main supply passage 31 closer to the inlet end 31A than the junction with the ATF warmer supply passage 37. As shown in FIGS. 4 and 5, the heater core return passage 36 extends to the left from the main return passage 32, and opens out at a lower part of the left side of the passage forming member 14. The heater core return passage 36 is positioned below the heater core supply passage 35. The heater core supply passage 35 is connected to the cooling water inlet of the heater core 22 via the pipe 18H, and the heater core return passage 36 is connected to the cooling water outlet of the heater core 22 via the pipe 18I. The heater core 22 is used as a part of a vehicle interior heating system, and exchanges heat between the air in the passenger compartment and the heated cooling water passing through the main body water jacket 12.

As shown in FIGS. 3 and 5, the throttle supply passage 39 branches off from a part of the main supply passage 31 closer to the inlet end 31A than the junction with the turbocharger return passage 34 is, and opens out in an upper part of the rear side of the passage forming member 14. The throttle supply passage 39 is connected to the extension 31E of the main supply passage 31. The throttle supply passage 39 branches off from a part of the main supply passage 31 more remote from the turbocharger return passage 34 than the heater core supply passage 35 and the ATF warmer supply passage 37 are. As shown in FIGS. 4 and 5, the throttle return passage 40 extends to the left from the main return passage 32, and opens out to a lower part of the left side of the passage forming member 14. The throttle supply passage 39 is connected to the inlet of the throttle water jacket 23A via the pipe 18J, and the throttle return passage 40 is connected to the outlet of the throttle water jacket 23A via the pipe 18K. The throttle water jacket 23A is a cooling water passage in a throttle body 23B that defines an intake passage of the electric throttle valve 23 for controlling the intake air flow.

As shown in FIG. 2, the passage forming member 14 is provided with a water temperature sensor 80 for detecting the temperature of the cooling water flowing through the branch passage 13. The water temperature sensor 80 is positioned in the vicinity of the inlet end 31A in order to detect the temperature of the cooling water immediately after passing through the main body water jacket 12. The water temperature sensor 80 is positioned in a part of the main supply passage 31 closer to the inlet end 31A than the junction with the turbocharger return passage 34 is, and closer to the inlet end 31A than the junction with the bypass passage 33 is. More specifically, as shown in FIGS. 3 to 5, the water temperature sensor 80 is inserted into a sensor hole 81 consisting of a through hole passed through a part of the passage forming member 14 opposing the inlet end 31A so that the detection end of the water temperature sensor 80 is positioned in the chamber portion 31C. The water temperature sensor 80 may consist of a per se known water temperature sensor such as a thermistor. The signal of the water temperature sensor 80 is forwarded to the control unit of the internal combustion engine 1. Based on the signal from the water temperature sensor 80, and the control unit controls the air fuel ratio, the ignition timing, the cooling fan of the radiator 15, etc.

The mode of operation of the cooling water passage structure 10 of the internal combustion engine 1 according to the present embodiment is described in the following. When the temperature of the cooling water is lower than the predetermined temperature, the flow control valve 54 closes the inlet end 32A of the main return passage 32 and shuts off the flow of the cooling water into the radiator 15. In this state, the main flow of the cooling water circulates through the water pump 16, the main body water jacket 12, the main supply passage 31, the bypass passage 33, and the main return passage 32, in that order. When the temperature of the cooling water is higher than the predetermined temperature, the flow control valve 54 opens the inlet end 32A of the main return passage 32. In this state, the cooling water circulates through the water pump 16, the main body water jacket 12, the main supply passage 31, the radiator 15, and the main return passage 32, in that order.

A part of the cooling water flows through the discharge port 16B of the water pump 16, the supply pipe 18D, the turbocharger water jacket 66, the discharge pipe 18E, and the turbocharger return passage 34 before flowing into the main supply passage 31. The cooling water flow passing through the turbocharger water jacket 66 is generated without regard to the state of the flow control valve 54. The cooling water heated by the turbocharger water jacket 66 flows from the outlet end 31B to the radiator 15 when the flow control valve 54 is open, and flows from the main supply passage 31 to the bypass passage 33 when the flow control valve 54 is closed.

A part of the cooling water passes through the main supply passage 31, the ATF warmer supply passage 37, the pipe 18F, the ATF warmer 21, the pipe 18G, and the ATF warmer return passage 38, in that order, before flowing to the main return passage 32. A part of the cooling water passes through the main supply passage 31, the heater core supply passage 35, the pipe 18H, the heater core 22, the pipe 18I, and the heater core return passage 36, in that order, before flowing to the main return passage 32. A part of the cooling water passes through the main supply passage 31, the throttle supply passage 39, the pipe 18J, the throttle water jacket 23A, the pipe 18K, the throttle return passage 40, in that order, before flowing to the main return passage 32. The flow of the cooling water through the ATF warmer 21, the heater core 22, and the throttle water jacket 23A is generated irrespective of the open and closed state of the flow control valve 54.

Since the water temperature sensor 80 is provided in a part of the main supply passage 31 closer to the inlet end 31A than the junction with the turbocharger return passage 34 is, the cooling water heated by passing through the turbocharger 8 flows into the part of the main supply passage 31 which is more downstream than the sensor 80. When the flow control valve 54 is open, the cooling water having passed through the turbocharger is prevented from flowing toward the radiator 15 and reaching the water temperature sensor 80. Therefore, the water temperature sensor 80 is prevented from being affected by the high temperature cooling water that has passed through the turbocharger 8, and can accurately detect the temperature of the cooling water that has just passed though the main body water jacket 12.

Furthermore, since the water temperature sensor 80 is provided more on the side of the inlet end 31A than the junction between the bypass passage 33 and the main supply passage 31 is, when the flow control valve 54 is closed, the cooling water that has passed through the turbocharger water jacket 66 is prevented from reaching the water temperature sensor 80 via the bypass passage 33.

In the main supply passage 31, the ATF warmer supply passage 37, the heater core supply passage 35, and the throttle supply passage 39 are provided closer to the inlet end 31A than the junction between the main supply passage 31 and the turbocharger return passage 34 is, the cooling water heated in the turbocharger water jacket 66 flows into the main supply passage 31 at a part which is more downstream than the ATF warmer supply passage 37, the heater core supply passage 35, and the throttle supply passage are. Therefore, the cooling water that has passed through the turbocharger water jacket 66 is prevented from flowing into the ATF warmer 21, the heater core 22, and the throttle water jacket 23A.

Further, in the main supply passage 31, since the heater core supply passage 35 and the throttle supply passage 39 are provided closer to the inlet end 31A than the junction between the main supply passage 31 and the bypass passage 33 is, even when the flow control valve 54 is closed, the cooling water that has passed through the turbocharger water jacket 66 is prevented from flowing into the heater core 22 and the throttle water jacket 23A via the bypass passage 33. In particular, since the heater core supply passage 35 and the throttle supply passage 39 are connected to the extension 31E, a sufficient distance from the turbocharger return passage 34 is ensured so that the cooling water that has passed through the turbocharger water jacket 66 is prevented from flowing to the heater core 22 and the throttle water jacket 23A in an even more effective manner.

Since the main supply passage 31 extends obliquely upward from the inlet end 31A to the outlet end 31B, even when air is contained in the cooling water, the air is smoothly discharged to the side of the radiator 15 together with the cooling water. The air discharged to the radiator 15 flows from the upper tank 15A to the reserve tank 15E, and is then discharged to the outside.

Since the outlet 66B of the turbocharger water jacket 66 is disposed above the inlet 66A thereof, even if the cooling water boils inside, the air or gas is smoothly discharged from the outlet 66B so that water vapor is prevented from being accumulated in the turbocharger water jacket 66. In particular, since the cross sectional area of the discharge pipe 18E connected to the outlet is larger than that of the supply pipe 18D connected to the inlet, air is discharged in an even more favorable manner. Since the turbocharger return passage 34 branching off from the main supply passage 31 is positioned above the outlet 66B of the turbocharger water jacket 66, the air or gas is allowed to flow smoothly through the discharge pipe 18E to the side of the turbocharger return passage 34.

Since the supply pipe 18D and the discharge pipe 18E are connected to the common coupling member 67, by fastening the coupling member 67 to the fastening surface 63A, the connection between the inlet 66A and the supply pipe 18D of the turbocharger water jacket 66 and the connection between the outlet 66B and the discharge pipe 18E can be accomplished at the same time. Therefore, the assembly work is simplified.

Since the passage forming member 14 is formed with the branch passage 13 that merges the respective passages extending to the radiator 15, the turbocharger 8, the ATF warmer 21, the heater core 22, and the electric throttle valve 23, the cooling water passage structure 10 can be simplified in structure and reduced in size.

Although the present invention has been described in terms of a preferred embodiment thereof, it is obvious to a person skilled in the art that various alterations and modifications are possible without departing from the spirit of the present invention.

For example, the flow control valve 54 may be provided in the bypass passage 33 or the outlet end 31B of the main supply passage 31, instead of the inlet end 32A of the main return passage 32. Further, when the vehicle has a CVT instead of the automatic transmission, the ATF warmer 21 may be replaced by a CVT warmer. Similarly as the ATF warmer 21, the CVT warmer receives cooling water, and heats the CVTF (CVT fluid) by exchanging heat between the cooling water and CVTF. The configuration of the passage for supplying the cooling water from the main supply passage 31 to the CVTF warmer may be similar to that of the ATF warmer supply passage 37, and the configuration of the passage for returning the cooling water from the CVT warmer to the main return passage 32 may be similar to that of the ATF warmer return passage 38.

The invention claimed is:

1. A cooling water passage structure for an internal combustion engine provided with a supercharger, comprising:

a passage forming member attached to a main body of the internal combustion engine, and internally defining a branch passage communicating with an outlet of a main body water jacket formed in the main body of the internal combustion engine; and a water temperature sensor provided in the passage forming member to detect a temperature of the cooling water flowing through the branch passage;

wherein the branch passage comprises a main supply passage including an inlet end communicating with the outlet of the main body water jacket and an outlet end communicating with an inlet of a radiator, and a supercharger return passage branching off from the main supply passage and communicating with an outlet of a supercharger water jacket formed in the supercharger, the water temperature sensor being positioned in a part of the main supply passage closer to the inlet end of the main supply passage than a junction between the main supply passage and the supercharger return passage is.

2. The cooling water passage structure according to claim 1, wherein the branch passage further comprises a heater core supply passage that branches off from a part of the main supply passage closer to the inlet end than the junction between the main supply passage and the supercharger return passage is, and is connected to an inlet of a heater core.

3. The cooling water passage structure according to claim 2, wherein the main supply passage is bent in an intermediate part thereof between the inlet end and the outlet end, and is provided with an extension extending from the inlet end away from the outlet end, the heater core supply passage branching off from the extension.

4. The cooling water passage structure according to claim 3, wherein the branch passage further comprises a working fluid warmer supply passage that branches off from a part of the main supply passage closer to the inlet end than the junction between the main supply passage and the supercharger return passage is, and is connected to an inlet of a working fluid warmer for exchanging heat between a working fluid of a transmission system and cooling water.

5. The cooling water passage structure according to claim 4, wherein the branch passage further comprises a throttle supply passage that branches off from a part of the main supply passage closer to the inlet end than the junction between the main supply passage and the supercharger return passage is, and is connected to an inlet of a throttle water jacket formed in a throttle body.

6. The cooling water passage structure according to claim 5, wherein the throttle supply passage branches off from a part of the main supply passage more remote from the supercharger return passage than the heater core supply passage and the working fluid warmer supply passage are.

7. The cooling water passage structure according to claim 1, wherein the branch passage further comprises:

a main return passage having a first end connected to an outlet of the radiator and a second end connected to an inlet of a water pump for pumping cooling water to an inlet of the main body water jacket;

a bypass passage connecting the main supply passage to the main return passage; and a flow control valve provided in at least one of the main return passage and the bypass passage to regulate a flow of cooling water in the bypass passage, the bypass passage being connected to a part of the main supply passage between the water temperature sensor and the junction with the supercharger return passage.

8. The cooling water passage structure according to claim 1, wherein the outlet of the supercharger water jacket is positioned above an inlet of the supercharger water jacket, and a pipe connected to the outlet of the supercharger water jacket has a larger cross sectional area than a pipe connected to the inlet of the supercharger water jacket.

9. The cooling water passage structure according to claim 8, wherein the inlet and outlet of the supercharger water jacket open out at a common fastening surface, and the pipes are connected to the inlet and outlet of the supercharger water jacket, respectively, via a common connecting member configured to be fastened to the common fastening surface.

* * * * *